US009199240B2

(12) United States Patent
Lessard

(10) Patent No.: US 9,199,240 B2
(45) Date of Patent: Dec. 1, 2015

(54) DRIVING DEVICE FOR A GRINDER, AND CORRESPONDING GRINDER

(75) Inventor: Fabrice Lessard, Cambrai (FR)

(73) Assignee: COMPAGNIE ENGRENAGES ET REDUCTEURS—MESSIAN—DURAND, Cambrai (FR)

( * ) Notice: Subject to any disclaimer, the term of this patent is extended or adjusted under 35 U.S.C. 154(b) by 614 days.

(21) Appl. No.: 13/536,457

(22) Filed: Jun. 28, 2012

(65) Prior Publication Data

US 2013/0001341 A1 Jan. 3, 2013

(51) Int. Cl.
*B02C 25/00* (2006.01)
*B02C 15/00* (2006.01)
*B02C 23/04* (2006.01)

(52) U.S. Cl.
CPC ..... *B02C 15/006* (2013.01); *B02C 23/04* (2013.01); *B02C 15/00* (2013.01); *B02C 15/007* (2013.01); *B02C 25/00* (2013.01); *Y10T 74/19014* (2015.01)

(58) Field of Classification Search
CPC .... B02C 25/00; B02C 15/006; B02C 15/007; B02C 15/10; B02C 15/00
USPC ..... 241/37.5, 101.2, 36, 117–121
See application file for complete search history.

(56) References Cited

U.S. PATENT DOCUMENTS

| | | | | |
|---|---|---|---|---|
| 4,013,235 | A | 3/1977 | Halloran, Jr. | |
| 4,609,155 | A * | 9/1986 | Garnier | 241/30 |
| 5,395,057 | A | 3/1995 | Williams, Jr. et al. | |
| 6,676,400 | B2 | 1/2004 | Ito | |
| 6,719,227 | B2 * | 4/2004 | Scuccato | 241/36 |
| 8,128,011 | B2 * | 3/2012 | Berger et al. | 241/30 |
| 8,692,495 | B2 * | 4/2014 | Berger et al. | 318/432 |
| 2005/0061897 | A1 | 3/2005 | Lipowski | |
| 2006/0027689 | A1 * | 2/2006 | Watano et al. | 241/36 |
| 2009/0279215 | A1 | 11/2009 | Chang et al. | |

FOREIGN PATENT DOCUMENTS

| | | | |
|---|---|---|---|
| CN | 101528353 | A | 9/2009 |
| EP | 1180850 | A2 | 2/2002 |
| TW | I220879 | B | 9/2004 |
| TW | 200947820 | A | 11/2009 |
| WO | WO 2008/049545 | A1 | 5/2008 |

OTHER PUBLICATIONS

Office Action dated May 26, 2014, which issued during the prosecution of Taiwan Patent Application No. 101123320, which corresponds to the present application.

An International Search Report, mailed Feb. 10, 2012, which issued during the prosecution of French Application No. 11 55800, which corresponds to the present application.

* cited by examiner

*Primary Examiner* — Faye Francis

(74) *Attorney, Agent, or Firm* — Blank Rome LLP

(57) ABSTRACT

This driving device for a grinder includes a toothed ring, at least two driving assemblies for the toothed ring. Each driving assembly includes an electric motor and a reduction gear unit. The driving device includes safety means suitable for preventing the starting of all the driving assemblies when at least one driving assembly is unavailable.

9 Claims, 1 Drawing Sheet

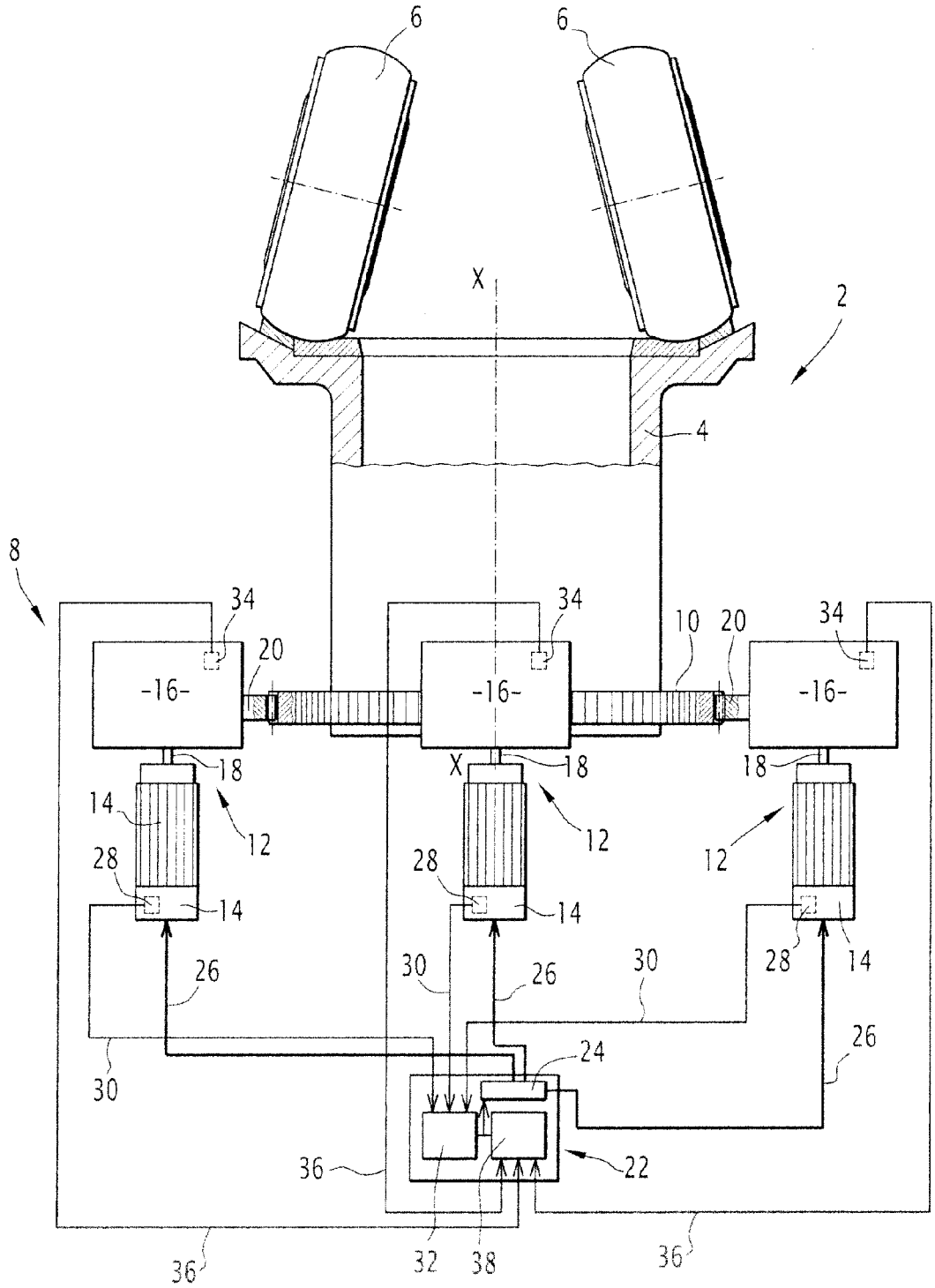
6
6
X
2
4
8
34
34
34
10
20
20
-16-
-16-
-16-
18
X
18
18
14
12
12
12
28
28
28
14
14
14
26
30
26
30
26
30
24
36
22
36
32
38
36

DRIVING DEVICE FOR A GRINDER, AND CORRESPONDING GRINDER

CROSS REFERENCE TO RELATED APPLICATION

This application claims priority under 35 U.S.C. §119 to French Patent Application No. 1155800, filed on Jun. 29, 2011. The contents of this application are incorporated by reference in their entirety.

FIELD OF THE INVENTION

The present invention relates to a driving device for a grinder, notably for a vertical grinder, comprising a toothed ring, at least two assemblies for driving the toothed ring, each driving assembly comprising an electric motor and a reduction gear unit.

BACKGROUND

Driving devices for grinders of this type are known.

However, these devices only have limited safety, given that during a failure of an electric motor or of a reduction gear unit, the operator may attempt to operate the driving device. In this case, either the remaining electric motors are used beyond their rated power or the force exerted on the components of the reduction gear unit or of the toothed ring is located beyond the foreseen forces.

SUMMARY OF INVENTION

The object of the invention is to provide a driving device for a grinder, which has increased safety and this with simple means.

For this purpose, the object of the invention is a driving device of the indicated type, characterized in that the driving device comprises a safety means suitable for preventing the starting of all the driving assemblies when at least one driving assembly is unavailable.

According to embodiments, the driving device comprises one or several of the following features:

- the driving device includes at least three driving assemblies;
- the safety means include failure detection means for detecting a failure of each driving assembly and control means suitable for preventing the starting of all the electric motors in response to a failure detection by the failure detection means;
- the failure detection means include for each electric motor, an electric motor failure sensor;
- the failure detection means include for each reduction gear unit, a reduction gear unit failure sensor;
- at least two driving assemblies, and preferably all the driving assemblies are identical.

The object of the invention is also a grinder, comprising:

a grinding table, at least one grinding roller, and and a driving device, characterized in that the driving device is a driving device as described above.

The invention will be better understood upon reading the following description, only given as an example and made with reference to the appended drawing, wherein the single FIGURE shows a grinder comprising a driving device according to the invention.

BRIEF DESCRIPTION OF DRAWING

The single FIGURE schematically shows a grinder according to the invention designated by the general reference.

DETAILED DESCRIPTION OF INVENTION

The grinder is a vertical grinder, which comprises a grinding table, several grinding rollers and a driving device for driving the grinding table into rotation. The grinding table is mobile in rotation around a vertical axis.

The driving device comprises a toothed ring fixed in rotation around the axis to the grinding table.

The driving device also comprises assemblies for driving the toothed ring. In this case, the driving device comprises three driving assemblies.

It should be noted that the grinder and the driving device do not include other means for driving the toothed ring or the grinding table. The means for driving the toothed ring into rotation around the axis are therefore formed by the driving assemblies.

Preferably, at least two, and notably all the driving assemblies are identical.

Each driving assembly comprises an electric motor as well as a reduction gear unit. The electric motor comprises an output shaft, which is connected to an input shaft not shown of the reduction gear unit. The reduction gear unit comprises an output pinion, which directly meshes with the toothed ring.

The driving device also comprises a control device, comprising a power supply module, which is connected through a power supply line to each of the electric motors. Thus, the power supply module is suitable for starting the electric motors.

The driving device also comprises safety means suitable for preventing the turning-on or starting of all the driving assemblies when at least one driving assembly is unavailable or faulty. In this case, the safety means include failure detection means suitable for detecting a failure of each driving assembly. The safety means also include a control means suitable for preventing the turning-on or starting of all the electric motors in response to a failure detection by the failure detection means.

The failure detection means comprise means for detecting failure of a motor, which are provided for each electric motor, suitable for detecting a failure of the associated electric motor on the one hand, and a signal line on the other hand. The motor failure detection means further include a module for evaluating the failure condition of the electric motors. Each signal line is connected to this evaluation module. The evaluation module is suitable for detecting the failure condition of one or several electric motors via the electric motor failure sensors and the signal lines and is suitable for emitting a motor failure signal to the power supply module. The power supply module is suitable for preventing powering of all the electric motors, as a response to this signal.

The failure detection means comprise reduction gear unit failure detection means, which are provided, for each reduction gear unit, with a reduction gear unit failure sensor suitable for detecting a failure of the associated reduction gear unit on the one hand, and with a signal line on the other hand. The reduction gear unit failure detection means include a module for evaluating the failure condition of the reduction gear units. The evaluation module is suitable for detecting the failure condition of one or several reduction gear units via reduction gear unit failure sensors and the signal lines and is suitable for emitting a reduction gear unit failure signal to the power supply module. The power supply module is suitable for preventing the powering of all the electric motors in response to this signal.

The invention operates in the following way.

When none of the motor failure sensors, and none of the reduction gear unit failure sensors detect any failure of an electric motor or of a reduction gear unit, modules and do not emit any failure signal and the power supply module allows the starting of each electric motor.

When at least one of the motor failure and reduction gear unit failure sensors detects a failure of a motor or reduction gear unit, the relevant evaluation module emits a failure signal to the power supply module, which, in response to this signal, blocks the turning-on or starting of each of the electric motors, so that upon failure of an electric motor or of a reduction gear unit, none of the driving assemblies are started. Thus, the use of the components outside their rated capacity is prevented in the case of a failure of a component.

The motor failure sensors may for example be a current sensor indicating the presence or absence of current in the coils of the motor or a force or torque sensor indicating the presence or the absence of force at the output shaft.

Also, the reduction gear unit failure sensor may be a force or torque sensor indicating the presence or the absence of force or of torque at a shaft of the reduction gear unit or of the output pinion.

The control device may be applied by a computer, a PLC or any other means.

The invention claimed is:

1. A driving device for a grinder, comprising:

a toothed ring, at least two driving assemblies for driving the toothed ring, each driving assembly comprising an electric motor and a reduction gear unit, characterized in that the driving device comprises safety means suitable for preventing the starting of all the driving assemblies when at least one driving assembly is unavailable.

2. The driving device according to claim 1, characterized in that the driving device includes at least three driving assemblies.

3. The driving device according to claim 1, characterized in that the safety means include failure detection means suitable for detecting a failure of each driving assembly and a control means, suitable for preventing the starting of all the electric motors in response to a failure detection by the failure detection means.

4. The driving device according to claim 3, characterized in that the failure detection means include for each electric motor an electric motor failure sensor.

5. The driving device according to claim 3, characterized in that the failure detection means include for each reduction gear unit a reduction gear unit failure sensor.

6. The driving device according to claim 1, characterized in that at least two driving assemblies are identical.

7. The driving device according to claim 1, characterized in that the grinder is a vertical grinder.

8. The driving device according to claim 1, characterized in that all the driving assemblies are identical.

9. A grinder, comprising a grinding table, at least one grinding roller, and a driving device, characterized in that the driving device is a driving device according to claim 1.

* * * * *